US005114316A

United States Patent [19]

Shimizu

[11] Patent Number: 5,114,316

[45] Date of Patent: May 19, 1992

[54] METHOD OF REGENERATING A VACUUM PUMPING DEVICE

[75] Inventor: Takayuki Shimizu, Kikuchi, Japan

[73] Assignee: Mitsubishi Denki Kabushiki Kaisha, Japan

[21] Appl. No.: 622,518

[22] Filed: Dec. 5, 1990

[30] Foreign Application Priority Data

Mar. 8, 1990 [JP] Japan ..... 2-54965

[51] Int. Cl.[5] ..... F04B 15/08

[52] U.S. Cl. ..... 417/53; 417/423.4; 417/901; 62/55.5

[58] Field of Search ..... 417/53, 901, 423.4; 62/55.5

[56] References Cited

U.S. PATENT DOCUMENTS 3,066,849 12/1962 Beams ..... 417/423.4

4,456,433 6/1984 Henning et al. ..... 417/53

4,479,927 10/1984 Gelernt ..... 52/55.5

4,485,631 12/1984 Winkler ..... 62/55.5

4,838,035 6/1989 Carlson et al. ..... 62/55.5

*Primary Examiner*—Richard A. Bertsch

*Assistant Examiner*—Charles Freay

*Attorney, Agent, or Firm*—Leydig, Voit & Mayer

[57] ABSTRACT

In a vacuum pumping device regeneration method, the temperature of the trap is raised to a temperature at which a molecule trapping chamber such as a cold molecules trapped by the trap are sublimated while the trap is maintained vacuum. Thereafter, the gas in which the molecules in a vapor state are present is removed from the trap without the temperature of the trap being raised to room temperatures without the pressure of the trap being to an atmospheric pressure. Consequently, contamination of the system can be avoided.

5 Claims, 2 Drawing Sheets

METHOD OF REGENERATING A VACUUM PUMPING DEVICE

BACKGROUND OF THE INVENTION

1. Field of the Invention

The present invention relates to a method of regenerating a vacuum pumping device.

2. Description of the Related Art

Conventionally, molecules trapped in a vacuum pumping device are degassed by a process called regeneration. This process includes raising the temperature of a molecule trapping chamber such as a cold trap to room temperature, discharging the gas in which the trapped molecules are present, evacuating the trap, and lowering the temperature of the trap.

The trapped molecules must be discharged periodically while the temperature of the trap is returned to that of the atmosphere. In order to achieve this, the operation of the devices for lowering the temperature of the trap is temporarily stopped to raise the temperature of the gas in which the trapped molecules are present to room temperature and thereby transform the trapped molecules into a vapor state. Thereafter, the gas in which the trapped molecules are present is discharged into the atmosphere.

As stated above, in the conventional regeneration of a vacuum pumping device, the temperature must be raised to room temperature and then lowered to a low value again. Furthermore, the interior of the device is exposed to the atmosphere and the device is evacuated. Thus, a long regeneration time is required, and contamination of the device may occur due to exposure of the interior thereof to the atmosphere.

SUMMARY OF THE INVENTION

Accordingly, an object of the present invention is to provide a method of regenerating a vacuum pumping device in which it is not necessary for the temperature of the vacuum pumping device to be raised to room temperature and for the pressure thereof to be raised to atmospheric pressure and in which the regeneration time can be reduced and a clean vacuum state can be effectively maintained.

In order to achieve the above object, the present invention provides a method of regenerating a vacuum pumping device with a molecule trapping chamber which comprises isolating the molecule trapping chamber from a process chamber, raising the temperature of the molecule trapping chamber from a low temperature to a temperature at which molecules trapped in the molecule trapping chamber are directly transformed into a vapor state while maintaining the interior of the molecule trapping chamber in a vacuum and evacuating the cold trap molecule trapping chamber.

DETAILED DESCRIPTION OF THE PREFERRED EMBODIMENTS

A first embodiment of the present invention will be described below with reference to FIG. 1.

Figure 1:
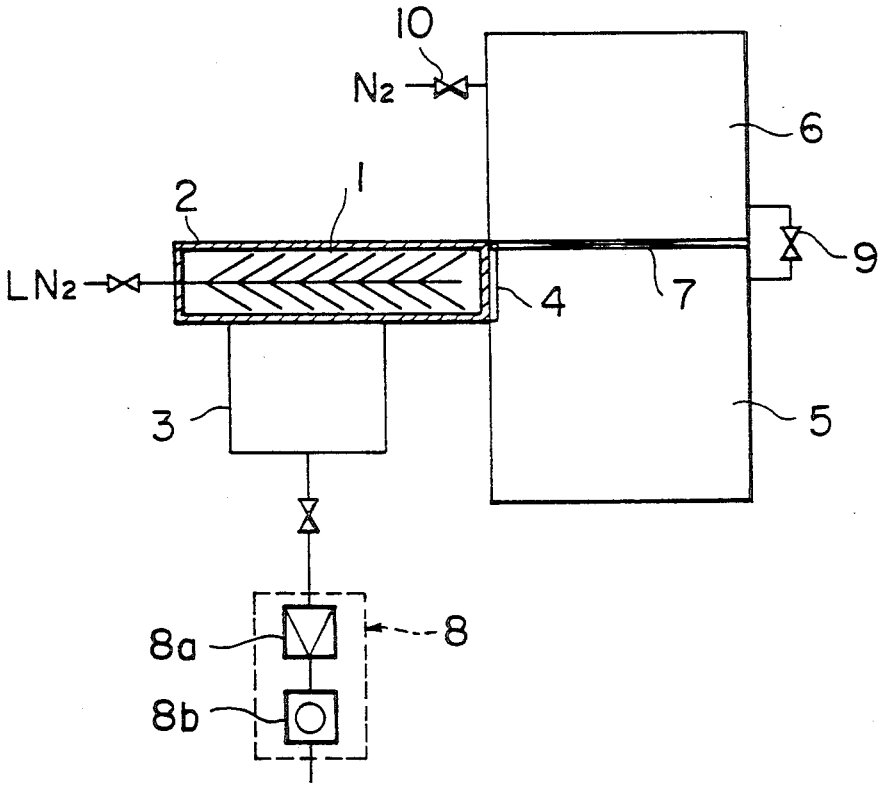
FIG. 1 is a schematic view of a first embodiment of a vacuum pumping device according to the present invention.

In the system shown in FIG. 1, a cold trap 1 is provided in a molecule trapping chamber in the form of a high vacuum chamber 2. A high vacuum pump 3 which may be a turbomolecular pump is disposed adjacent to the high vacuum chamber 2. The high vacuum chamber 2 is separated from a process chamber 5 by means of an isolation valve 4. The process chamber 5 is connected to a load chamber 6 through an isolation valve 7. A mechanical booster pump 8*a* and a rotary pump 8*b* are housed in a pump chamber 8. A bypass valve 9 is connected to the process chamber 5 and to the load chamber 6. A vent valve 10 is connected to the load chamber 6.

In the conventional regeneration method of a vacuum pumping device with a cold trap, the pressure in the high vacuum chamber 2, process chamber 5 and load chamber 6 is returned to atmospheric pressure while the temperature thereof is raised to room temperature. Thereafter, the molecules trapped in the cold trap 1 are discharged to the atmosphere, and the temperature of these chambers is lowered again and at the same time these chambers are evacuated. In this way, contamination of the vacuum chamber cannot be avoided.

In the vacuum pumping device regeneration method according to the present invention, the temperature of the cold trap 1 is gradually raised not to room temperature but to a temperature at which the molecules trapped by the cold trap 1 in the high vacuum chamber 2 are transformed directly into a vapor state for degassing in a state in which the isolation valve 4 is closed. Thereafter, the gas in the high vacuum chamber 2 is evacuated by operating the turbomolecular pump 3.

In this way, the molecules trapped in the high vacuum chamber 2 are removed for regeneration of the vacuum pumping device.

Subsequently, the interior of the high vacuum chamber 2 is evacuated to a predetermined pressure, and the temperature thereof is lowered.

In the above-described embodiment, a cold trap is used as a low temperature molecule trapping device. However, the present invention may also be used to regenerate a molecule trapping device in the form of a cryopump, In a case where a dry-type high vacuum pump is provided in the vacuum pumping device or in the chamber, the high vacuum pump can be used to carry out the present invention.

Figure 2:
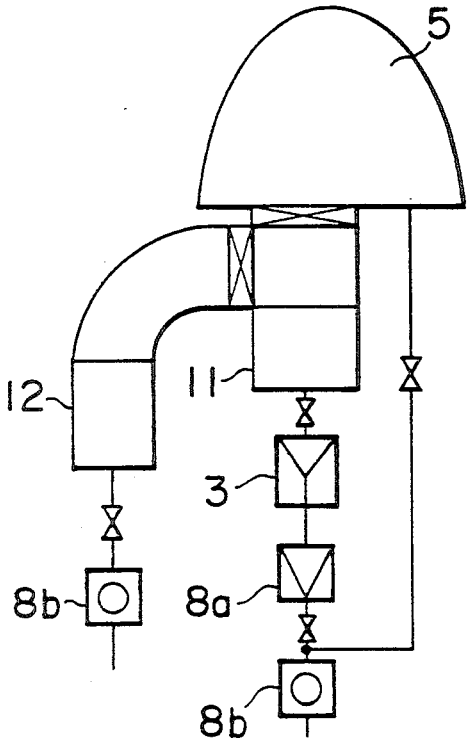
FIGS. 2 to 4 are schematic views of other embodiments of the vacuum pumping device according to the present invention.
Figure 3:
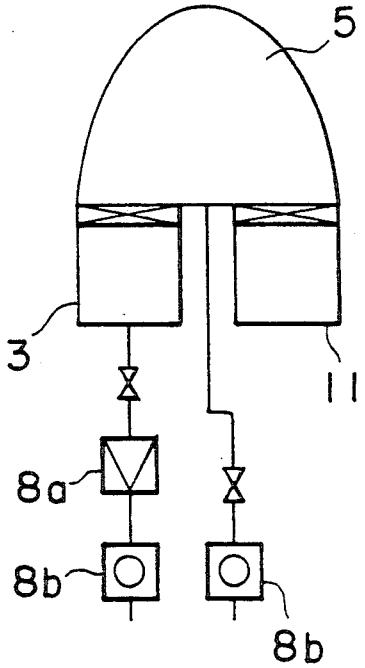
Figure 4:
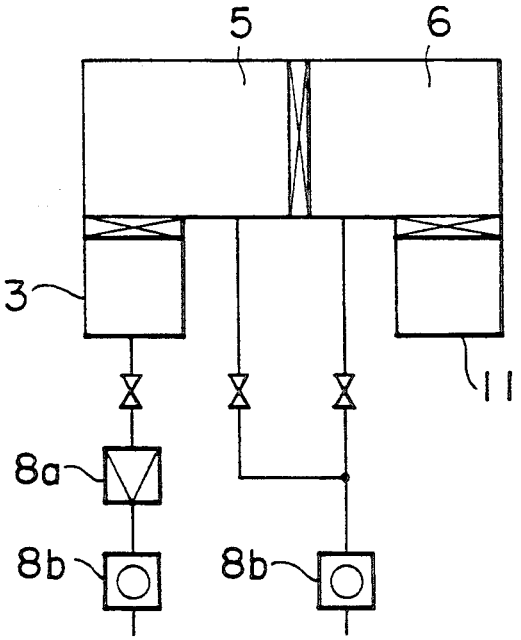

FIG. 2 shows an example in which a cryopump 11 is used as a molecule trapping device and a drag pump 12 is used as a regeneration pump. FIG. 3 shows an example in which a turbomolecular pump 3 and a cryopump 11 connected to a chamber 5 are used in common for regeneration and processing. FIG. 4 shows an example in which two chambers are connected with each other through an isolation valve and in a turbomolecular pump 3 and a cryopump 11 are respectively connected to the chambers. The structure of these examples is otherwise the same as that of the above-described embodiment.

As will be understood from the foregoing description, in the regeneration method according to a present invention, the vacuum portion is not exposed to the atmosphere therefore is not contaminated by the atmosphere. Furthermore, since the temperature is not raised to room temperature, regeneration time can be reduced, and the trapped molecules can be almost completely discharged. Hence, the system can be restored in an operable state in a short period of time, and contamination of the interior does not occur.

What is claimed is:

1. A method of regenerating a vacuum pumping device having a molecule trapping chamber for generating a vacuum in a process chamber, comprising the steps of:

isolating the molecule trapping chamber from a process chamber;

raising the temperature of the molecule trapping chamber from a first temperature at which molecule trapping can be performed to a second temperature below room temperature at which molecules trapped in the molecule trapping chamber are directly transformed into a vapor state while maintaining the interior of the molecule trapping chamber isolated from the exterior of the molecule trapping chamber; and evacuating the molecule trapping chamber to remove molecules transformed into a vapor state.

2. A regeneration method according to claim 1 wherein the molecule trapping chamber comprises a cold trap.

3. A regeneration method according to claim 2 wherein the molecule trapping chamber comprises a cryopump.

4. A regeneration method according to claim 1 wherein the step of evacuating comprises evacuating with a turbomolecular pump.

5. A regeneration method according to claim 1 wherein the step of evacuating comprises evacuating with a drag pump.

* * * * *